US006584632B1

(12) United States Patent
Mittenberger

(10) Patent No.: US 6,584,632 B1
(45) Date of Patent: Jul. 1, 2003

(54) FUTON FLIPPER

(76) Inventor: Kristopher M. Mittenberger, 42 Old Saddle Rd., Ridge, NY (US) 11961

( * ) Notice: Subject to any disclaimer, the term of this patent is extended or adjusted under 35 U.S.C. 154(b) by 0 days.

(21) Appl. No.: 10/084,220

(22) Filed: Feb. 28, 2002

(51) Int. Cl.[7] ..... A47C 31/00
(52) U.S. Cl. ..... 5/658; 5/37.1; 294/154
(58) Field of Search ..... 5/658, 37.1; 294/154, 294/170

(56) References Cited

U.S. PATENT DOCUMENTS

| | | | | | |
|---|---|---|---|---|---|
| 756,304 | A | * | 4/1904 | Webster | 294/75 |
| 1,175,024 | A | * | 3/1916 | Thorson | 294/154 |
| 1,472,997 | A | * | 11/1923 | Stevenson | 294/170 |
| 2,486,827 | A | * | 11/1949 | Duncan | 294/154 |
| 2,944,713 | A | | 7/1960 | Beach | 224/45 |
| 3,188,130 | A | * | 6/1965 | Pietrowicz | 294/74 |
| 4,370,767 | A | | 2/1983 | Fraser | 5/417 |
| 4,901,897 | A | | 2/1990 | Briggs et al. | 324/153 |
| 5,370,286 | A | | 12/1994 | Newman | 224/151 |
| 5,785,223 | A | * | 7/1998 | Matsushita | 224/609 |

* cited by examiner

*Primary Examiner*—Teri Pham Luu

(57) ABSTRACT

A strap system for folding a futon having a mattress. The strap system includes two end loops attachable to the frame of the futon, adjustable straps attached to each end loop and a handle between the straps.

7 Claims, 4 Drawing Sheets

FUTON FLIPPER

BACKGROUND OF THE INVENTION

This invention relates to a strap system for closing a futon frame that has a mattress.

DESCRIPTION OF THE PRIOR ART

Strap systems that can be used to assist in carrying or moving objects are known in the prior art. For example, U.S. Pat. No. 2,944,713 to Beach discloses a strap system with a handle that can be attached to a container at two locations for carrying the container.

U.S. Pat. No. 4,370,767 to Fraser discloses a strap for holding a beach mat in a rolled up configuration.

U.S. Pat. No. 5,370,286 to Newman discloses a carrying strap having end loops, a handle in the middle and adjustable straps between the handle and the end loops.

U.S. Pat. No. 4,901,897 to Briggs et al. discloses a garment bag with adjustable shoulder straps to carry the bag.

The present invention is directed to a strap system to move a furniture piece, such as a futon, from an open to a closed position. The strap system has end loops whose length can be adjusted with belt buckles, connecting adjustable length strap members for each end loop and a handle between the strap members, all as will be detailed in the specification that follows hereafter.

SUMMARY OF THE INVENTION

This invention relates to a strap system used to close an opened futon.

It is the primary object of the present invention to provide for an improved strap system for use with a furniture piece that has movable portions.

Another object is to provide for such a strap system designed for closing an open futon.

Another object is to provide for a strap system which can be used by persons with handicaps or elderly persons.

These and other objects and advantages of the present invention will become apparent to readers from a consideration of the ensuing description and the accompanying drawings.

DESCRIPTION OF THE PREFERRED EMBODIMENT

Figure 1:
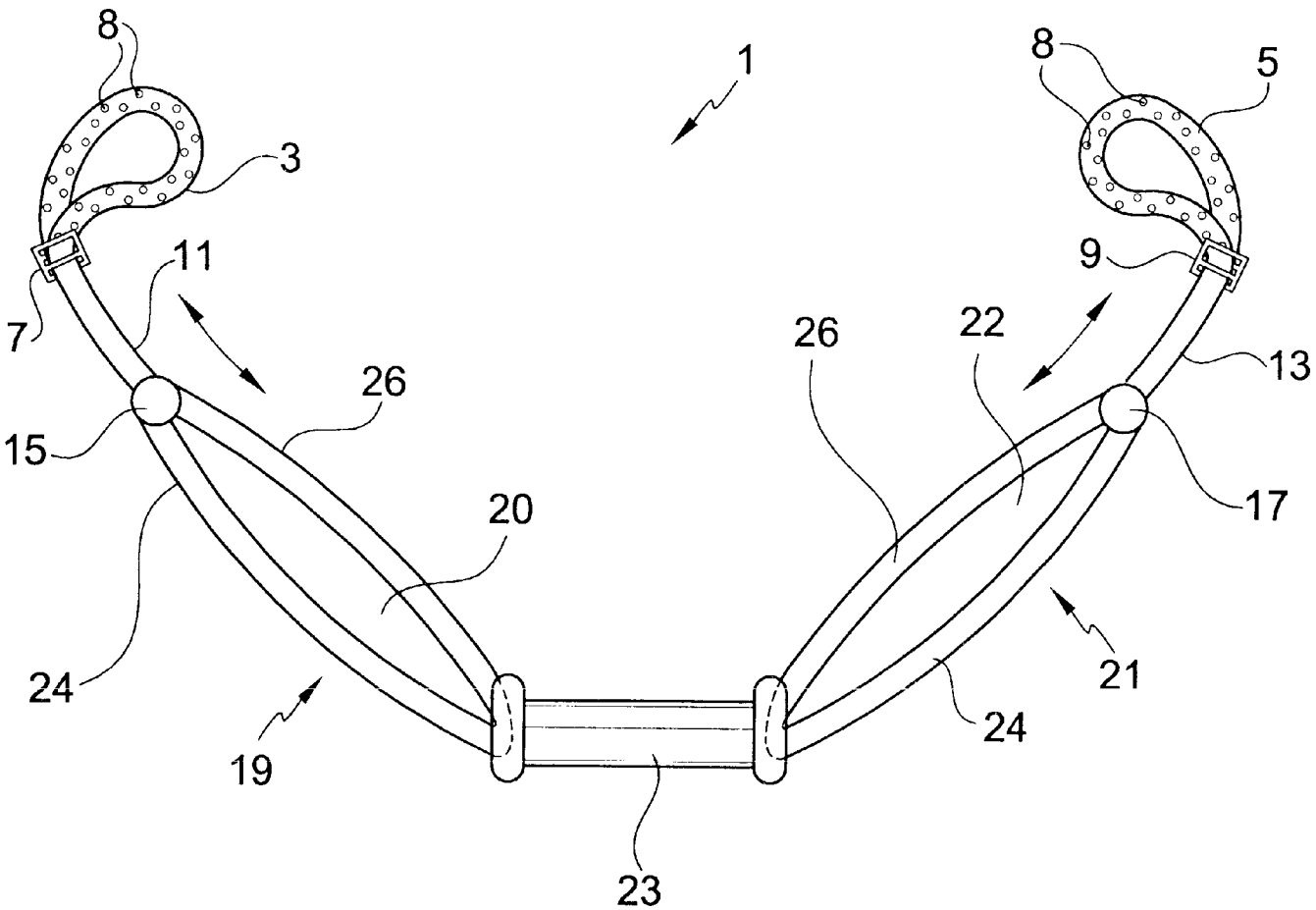
FIG. 1 is a front view of the present invention.

FIG. 1 is a front view of the present invention showing the strap system 1. The system 1 has two end loops 3,5, two buckles 7, 9 to allow the end loops to be adjusted, two connecting links 11, 13, adjustors 15, 17 for the two strap members 19, 21 and a handle 23. Each of the loops 3, 5, as well as the two strap members 19, 21, may be adjusted in length independent of the other loop or strap member. The conventional belt type buckles 7, 9 permit the loops to be adjusted in length. Holes 8, along the lengths of each loop

3, 5, permit elongated engaged members (not shown) on the belt buckle 7, 9 to vary the lengths of the loops. Similarly, the adjustors 15, 17 engage the ends of the strap members 19, 21 to permit their lengths to be adjusted. The adjustors 15, 17 may slide back and forth along the length of each strap member 19, 21 to vary the length of strap loops 20, 22. The strap members 19, 21 and the adjustors 15, 17 may be made of nylon material, although other suitable materials can also be used. Also, the adjustors 15, 17 are conventional, therefore, no further description is necessary or will be given.

Each of the strap members 19,21 is fixed to an end of the handle 23 in any conventional manner. The two segments 24, 26 of each strap member 19, 21, respectively, extend from the handle 23 towards each of the adjustors 15, 17. The handle may be made of a strong, lightweight plastic material with a nonslip surface. The linking members 11, 13 may be extensions to the strap members 19, 21 after they have passed through their respective adjustors 15 or 17. It is important that the strap system 1 have sufficient strength to do the intended function of moving the reclined (opened) back portion of a futon to a closed position. It is also important that the strap system have adjustable length components as described so it can be used with futons of different sizes. The individual sub components forming the strap system 1 (e.g., the loops 3, 5, buckles 7, 9, strap members 19, 21, adjustors 15, 17 and handle 23) are each in themselves conventional in construction and available commercially as off the shelf items.

Figure 2:
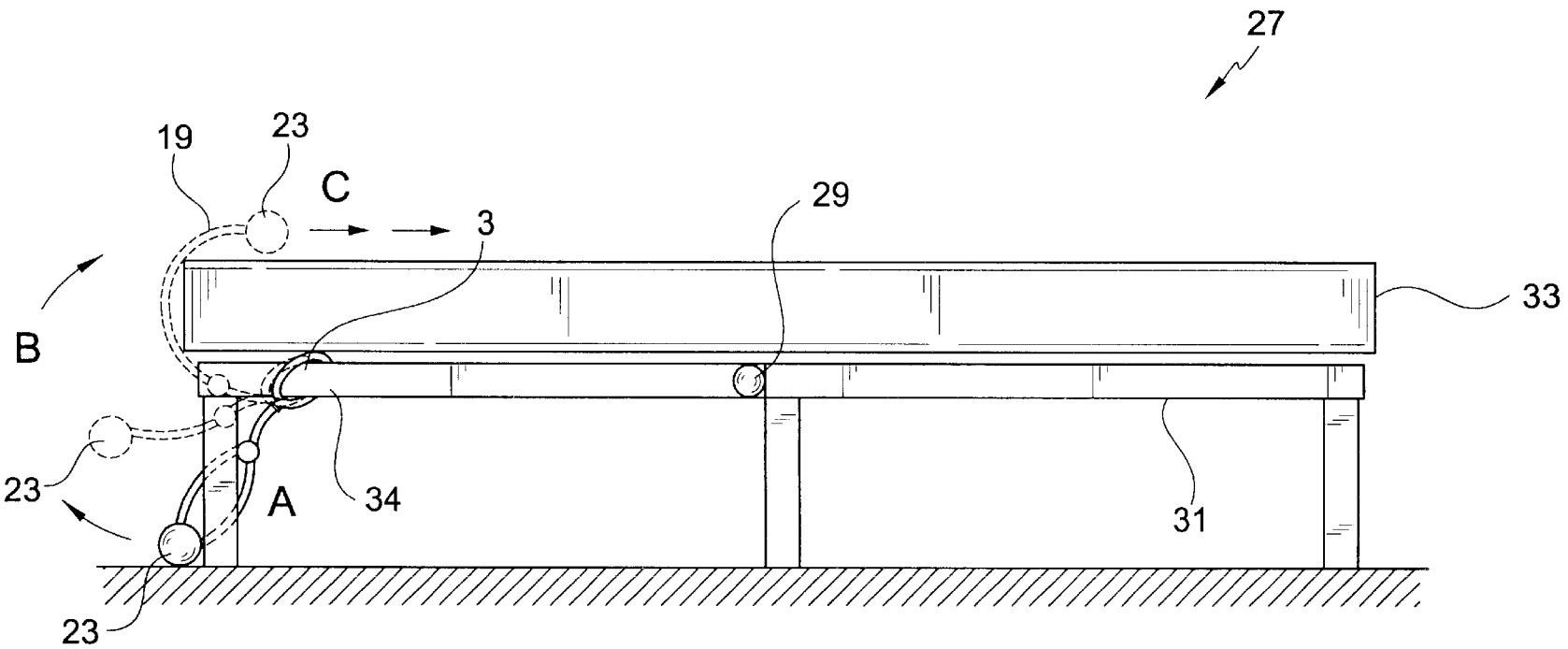
FIG. 2 is a side view of the present invention on a fully opened or reclined futon.

FIG. 2 is a side view of the strap system of FIG. 1 on a fully reclined or opened futon 27. The movement of the strap system 1 from one position to another is shown in dotted line format. Any necessary length adjustments to the loops 3, 5 or connecting strap members 19,21 have been previously made. Typically, the futon 27 has a pivot joint 29 located on the supporting futon frame 31. The pivot joint represents the demarcation between the seat portion (to the right) and the back portion of the futon. Above the frame 31 is a conventional mattress 33 whose left hand portion or back portion, see arrow, folds around the pivot joint 29.

To raise the frame back with the mattress, the strap system, initially shown in the solid line position A, is moved by the handle 23 first to intermediate position B, and then to position C. In position C, the strap members 19,21 wrap around the upper end of the mattress. Pulling on handle 23 elevates both the back portion of the frame 31 and the mattress 33 to a generally vertical position (see FIG. 3). Before the handle is pulled, each of the end loops 3, 5 have been previously secured to the frame members 34, 36 (only member 34 is shown in FIG. 2) at or near the top end on the back frame portion of the futon 27. By lifting the handle 23 from positioned A the two strap members 19, 21 bear against the surface of the mattress 33 at two spaced locations providing for a gripping action which allows the user to pull the handle when in position C to pivot the frame 31 and fold the mattress and the frame at the same time. There are three supporting pairs of legs for the frame 31 with one pair 35 being located on the back portion of the frame.

Figure 3:
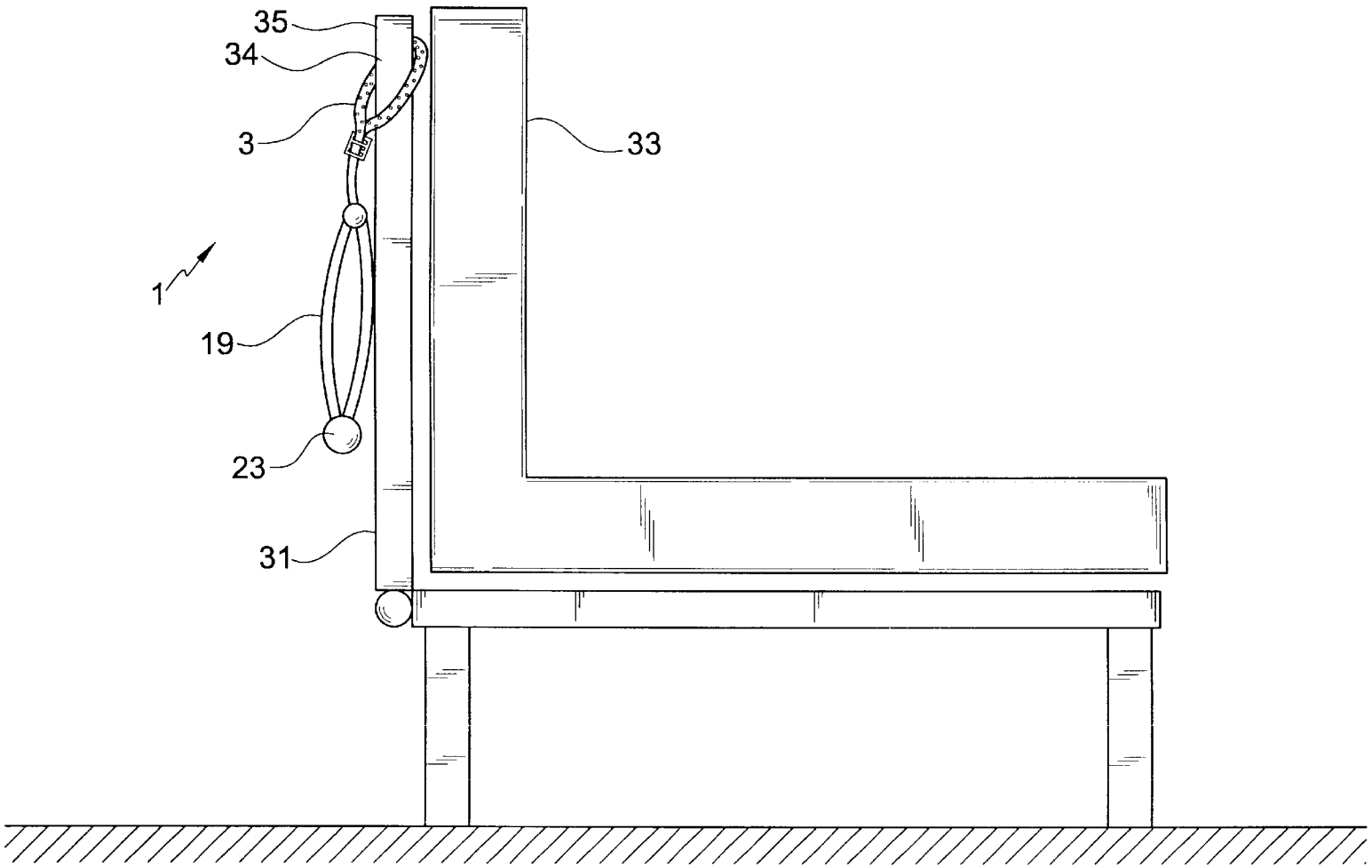
FIG. 3 is a side view of the present invention with the futon closed and the back portion raised.

FIG. 3 is a side view of the strap system on the futon 27 with the back portion raised and the strap system 1 attached. In FIG. 3, the back portions of the frame 31 and the mattress 33 are each generally vertically disposed. After pulling on the handle 23 to raise the futon (see arrows D in FIG. 2), the handle 23 and connecting straps 19, 21 would extend, or drape downwardly, from the attached spaced locations 34, 36 where the two end loops 3, 5 are attached to the frame. When so positioned, the strap system 1 would be hidden from view, when viewing the futon head on from the front. Thus, it is only when the strap system 1 is to be used that the strap system is visible. The two supporting legs 35 (one of which is shown in FIG. 2) are mounted to the back frame portion of the futon and can each be pivoted or otherwise retracted into the frame 31.

Figure 4:
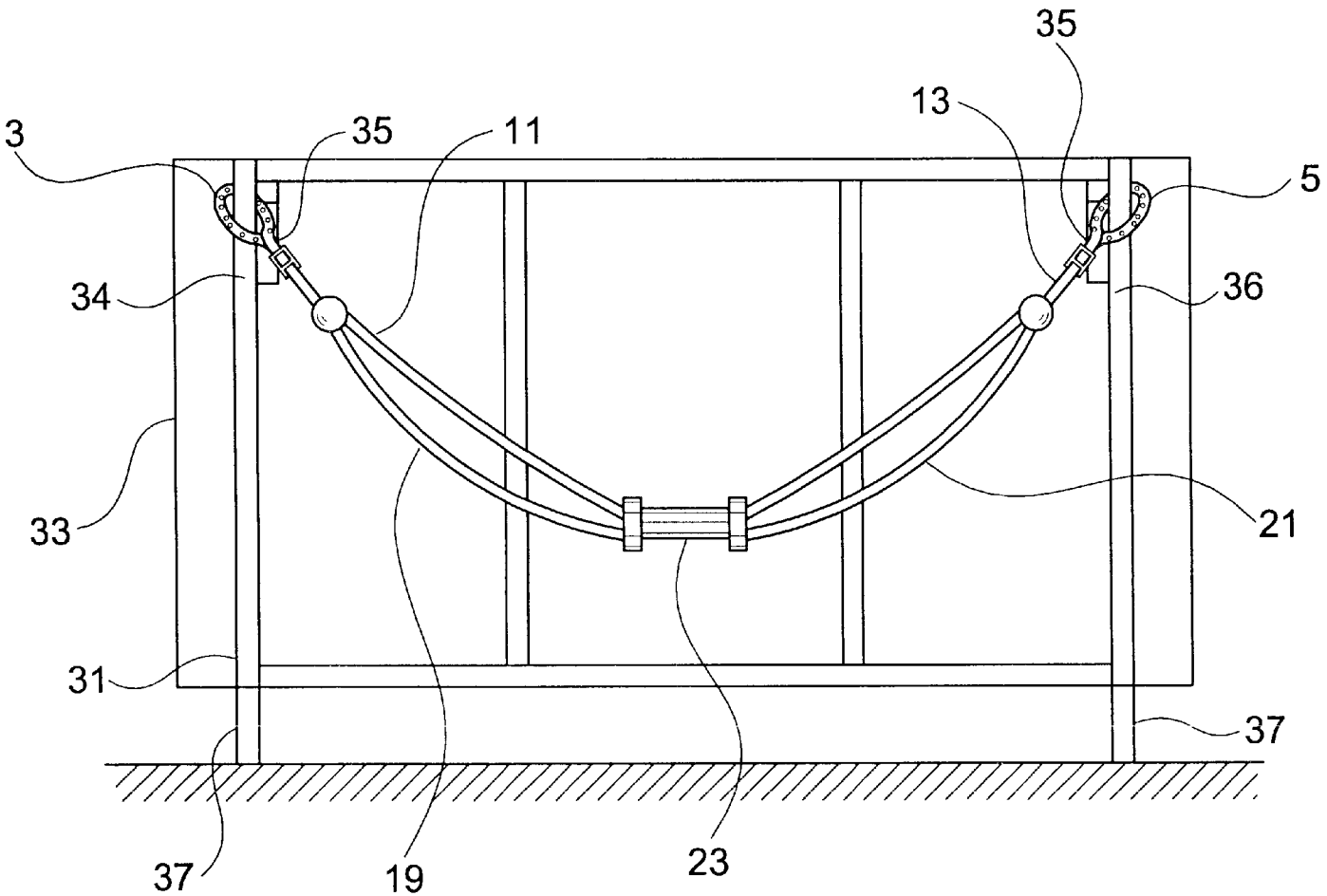
FIG. 4 is a back view showing the present invention on a futon.

FIG. 4 is a back view of the futon 27 showing the strap system 1. The two end loops 3, 5 have each been tightly looped around opposite side frame members 34, 36 adjacent the retracted legs 35. Depending from the loops 3, 5 are the links 11, 13 and the attached strap members 19, 21. At approximately the mid portion of the strap system is handle 23. The back portion of the frame 31 and mattress 33 are depicted forward of the strap system. One of the pairs of frame legs 37 is shown. Another pair of legs is directly in front of pair 37 and therefore not shown.

To retract the back of the frame and the mattress, a user simply pushes from the front of the mattress to move the frame and mattress to the FIG. 1 position. When the frame is in a horizontal position, if the user desires to again raise the frame and mattress back portions to the FIGS. 2–3 position, the user takes handle 23 and pulls it up and then forward in the direction of the arrows D, as shown in FIG. 2.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A strap system in combination with an adjustable furniture piece comprising:

a furniture piece having a frame part which can be movable between a first position and a second position, a first loop having means for securing the first loop around a movable frame part, a second loop spaced from said first loop and having means for securing the second loop at another location on the movable frame part, a first strap member connected to said first loop, said first strap member having means for adjusting the length of the first strap, a second strap member connected to said second loop, said second strap member having means for adjusting the length of the second strap, and a handle connecting the first strap member to the second strap member.

2. The combination as claimed in claim 1, wherein said furniture piece is a futon, said futon having a back portion and a seat portion, said back portion being movable relative to said seat portion.

3. The combination as claimed in claim 2, wherein said first loop and said second loop each have means for adjusting the lengths of said loops.

4. The combination as claimed in claim 3, wherein the means for adjusting the lengths of the first loop and the second loop may be independently adjusted.

5. The combination as claimed in claim 4, wherein the means for adjusting the length of the first loop and the second loop comprises a separate belt buckle for the first loop and for the second loop.

6. The combination as claimed in claim 5, wherein said first strap member and said second strap member each having means for independently adjusting the length of the first strap member and the length of the second strap member, one of said means for adjusting the length being mounted on the first strap member and being slidable along the length of the first strap member, and another of said means for adjusting the length of the second strap member being slidable along the length of the second strap member.

7. A method of using a strap system in combination with an adjustable furniture piece, wherein said combination comprises:

a furniture piece having a frame part which can be movable between a first position and a second position, a first loop having means for securing the first loop around a movable frame part, a second loop spaced from said first loop and having means for securing the second loop at another location on the movable frame part, a first strap member connected to said first loop, said first strap member having means for adjusting the length of the first strap, a second strap member connected to said second loop, said second strap member having means for adjusting the length of the second strap, and a handle connecting the first strap member to the second strap member, and wherein said method comprises the steps of:

(a) attaching the first loop to a first location on the movable frame part, (b) attaching the second loop to a second location on the movable frame part spaced from the first location, (c) adjusting the lengths of the first loop and the second loop to insure a tight fit around the frame at the first location and the second location, (d) pulling the handle upwardly over a back portion of the frame to move the movable frame part from the first position to the second position, said second position being substantially elevated relative to the first position.

* * * * *